United States Patent [19]

Whitehead et al.

[11] Patent Number: 4,885,783

[45] Date of Patent: Dec. 5, 1989

[54] ELASTOMER MEMBRANE ENHANCED ELECTROSTATIC TRANSDUCER

[75] Inventors: Lorne A. Whitehead, Vancouver, Canada; Robert L. Clark, Pleasanton, Calif.; Francis L. Curzon, Vancouver, Canada

[73] Assignee: The University of British Columbia, Vancouver, Canada

[21] Appl. No.: 37,265

[22] Filed: Apr. 10, 1987

[30] Foreign Application Priority Data

Apr. 11, 1986 [CA] Canada ..... 506496

[51] Int. Cl.[4] ..... H04R 19/00

[52] U.S. Cl. ..... 381/191

[58] Field of Search ..... 381/191, 190; 307/400; 361/312, 313, 323, 326

[56] References Cited

U.S. PATENT DOCUMENTS

| | | | |
|---|---|---|---|
| 2,221,671 | 11/1940 | Cooper | 361/326 |
| 2,796,467 | 6/1957 | Kock . | |
| 2,872,532 | 2/1959 | Buchmann . | |
| 3,118,979 | 1/1964 | Sessler et al. . | |
| 3,373,251 | 3/1968 | Seeler . | |
| 3,736,436 | 5/1973 | Crites | 381/191 |
| 3,742,152 | 6/1973 | Lewiner et al. . | |
| 3,769,532 | 10/1973 | Tocquet et al. . | |
| 3,787,642 | 1/1974 | Young, Jr. . | |
| 3,821,491 | 6/1974 | Whetstone et al. | 307/400 |
| 3,851,183 | 11/1974 | Lewiner et al. | 381/191 |
| 3,890,511 | 6/1975 | Haugsjaa et al. | 381/191 |
| 3,978,446 | 8/1976 | Miller | 307/400 |
| 4,041,446 | 8/1977 | Liebermann . | |
| 4,081,626 | 3/1978 | Muggli et al. . | |
| 4,105,877 | 8/1978 | Peters | 381/191 |
| 4,151,378 | 4/1979 | Watson . | |
| 4,246,449 | 1/1981 | Biber . | |
| 4,250,415 | 2/1981 | Lewiner et al. | 381/191 |
| 4,620,262 | 10/1986 | Olsen | 361/323 |

FOREIGN PATENT DOCUMENTS 1376335 12/1974 United Kingdom ..... 307/400

OTHER PUBLICATIONS

W. B. Gauster and M. A. Breazeale, Detector for Measurement of Ultrasonic Strain Amplitudes in Solids, Rev. Sci. Instrum. 37, 1544 (1966).

J. H. Cantrell and M. A. Breazeale, Elimination of Transducer Bond Corrections in Accurate Ultrasonic-Wave Velocity Measurements by Use of Capacitive Transducers, J. Acoust. Soc. Am. 61, 403 (1977).

J. H. Cantrell and J. S. Heyman, Broadband Electrostatic Acoustic Transducer for Ultrasonic Measurements in Liquids, Rev. Sci. Instrum. 50, 31 (1979).

D. Friedmann, F. L. Curzon and J. Young, A New Electrical Breakdown Phenomenon in Gas-Filled Insulating Bulbs, Appl. Phys. Lett. 38, 414 (1981).

*Primary Examiner*—Gerald Brigance
*Assistant Examiner*—Alvin Oberley
*Attorney, Agent, or Firm*—Flehr, Hohbach, Test, Albritton & Herbert

[57] ABSTRACT

A transducer having opposed first and second conductive plates for application of an electrical potential difference therebetween. An elastomeric dielectric material such as neoprene rubber is disposed between the plates and in contact therewith. The dielectric material has a plurality of pockets of approximate average depth "d" such that, for a given gas maintained within the pockets at a pressure "P", the product Pd is significantly less than the value required to achieve the minimum breakdown voltage for the gas in the pockets. Alternatively, the elastomeric dielectric material disposed between the plates may take the form of a plurality of strips or nodules which separate the plates by a distance "d" as above.

12 Claims, 5 Drawing Sheets

~ 10μm

SCANNING ELECTRON MICROGRAPH OF SHEET NEOPRENE RUBBER SURFACE (3000 X)

ELASTOMER MEMBRANE ENHANCED ELECTROSTATIC TRANSDUCER

FIELD OF THE INVENTION

This application pertains to electrical-to-mechanical transducers. More particularly, the application pertains to an electrostatic transducer in which an elastomeric dielectric material is disposed between a pair of opposed conductive plates across which an electrical potential difference is maintained. Slight surface irregularities or pockets in the dielectric material facilitate dramatic increases of the electric breakdown field in the microscopic gap between the plates and the dielectric material, or in the pockets, thereby yielding extremely high electrostatic forces. Very thin deposits of dielectric material may alternatively be used to maintain a very narrow gap between the opposed plates, thereby also increasing the gap breakdown voltage, yielding extremely high electrostatic forces and increased compliance of the device.

BACKGROUND OF THE INVENTION

A variety of electrical-to-mechanical transducers exist. Familiar examples include the electrostatic transducers incorporated in loudspeakers, the electromagnetic transducers incorporated in electric gauges and the piezoelectric or magnetostrictive transducers used, for example, in certain narrow band underwater signalling applications. Conventional electrostatic transducers typically utilize the electrostatic force generated by applying an electrical potential difference between a pair of opposed metal plates separated by an air gap. In an electromagnetic transducer, an electric current causes a force to be applied to a wire maintained in a magnetic field, thereby moving the wire and whatever it may contact. Piezoelectric transducers incorporate certain crystals which change their shape, and thus move slightly, in response to an applied electric field. Magnetostrictive transducers incorporate certain metals which change their shape, and thus move slightly, in response to an applied magnetic field.

For comparison purposes, it is useful to consider transducers having a volume of the order of 100 ml. Conventional electrostatic transducers of this sort have relatively low mechanical impedance (ranging from about 1 to about 100 Newton seconds per meter) and are capable of producing only relatively small forces (typically about 0.05 to about 0.5 Newtons). The mechanical impedance range of electromagnetic transducers is about the same as that of conventional electrostatic transducers, although electromagnetic transducers are capable of producing forces of about 0.5 to about 10 Newtons. Piezoelectric and magnetostrictive transducers, on the other hand, have extremely high mechanical impedance (ranging from about $10^6$ to about $10^8$ Newton seconds per meter) and generate extremely high forces (on the order of about $10^3$ to about $10^4$ Newtons). It can thus be seen that there is a conspicuous lack of electrical-to-mechanical transducers which, in the 100 ml. size range, would have a mechanical impedance on the order of about $10^3$ to about $10^5$ Newton seconds per meter and be capable of producing forces in the range of about 10 to about $10^3$ Newtons. The present invention provides an electrostatic transducer which fills this gap in the prior art.

SUMMARY OF THE INVENTION

In accordance with a first embodiment, the invention provides a transducer, comprising opposed first and second conductive plates between which an electrical potential may be applied; and, an elastomeric dielectric material disposed between the plates and in contact therewith. The dielectric material has a plurality of pockets of approximate average depth "d" such that, for a given gas maintained within the pockets at a pressure "P", the product Pd is significantly less than the value required to achieve the minimum breakdown voltage of the gas. The large breakdown voltages correspond to high electric fields and correspondingly high electrostatic forces. At the same time, the deformability of the elastomeric dielectric material, in conjunction with the gas-filled pockets, enables the structure to be relatively compliant, thus achieving a mechanical impedance in the desired range.

Alternatively, in a second embodiment of the invention, the elastomeric dielectric material may take the form of small strips or nodules disposed between the plates and in contact therewith, thereby separating the plates by a distance "d" such that, for a given gas maintained between the plates at a pressure "P", the product Pd is significantly less than the value required to achieve the minimum breakdown voltage of the gas. Advantageously, the elastomeric dielectric material is disposed between the plates at a plurality of discrete sites, thus leaving a gas-filled gap between and in contact with both plates in regions not occupied by the dielectric material. In a particularly preferred embodiment, a first plurality of strips of elastomeric dielectric material are disposed between the plates in a first direction; and, a second plurality of strips of elastomeric dielectric material are disposed between the plates in a second direction different from the first direction, thereby increasing the compliance of the elastomeric material and decreasing the mechanical impedance of the transducer so as to facilitate large displacements in response to comparatively small voltages.

Another particularly preferred embodiment of the invention provides a plurality of conductive plates which may be arranged in a stack. An electrical potential may be applied between each pair of opposed plates comprising the stack. An elastomeric dielectric material is disposed between and in contact with each pair of opposed plates comprising the stack. The dielectric material separates each of the pairs of opposed plates by a distance "d" such that, for a given gas maintained between the plates at a pressure "P", the product Pd is significantly less than the value required to achieve the minimum breakdown voltage of the gas.

Advantageously, an electrical insulating material may be disposed between each of the plates and the elastomeric dielectric material so as to increase the gas breakdown voltage, and to lessen the deleterious effects of accidentally exceeding that voltage.

If the gas is air, and if "P" is normal atmospheric pressure, then "d" is preferably about 16 microns or less.

The elastomeric dielectric material is preferably neoprene rubber. The conductive plates are preferably formed of aluminized mylar.

DETAILED DESCRIPTION OF THE PREFERRED EMBODIMENT

Figure 1:
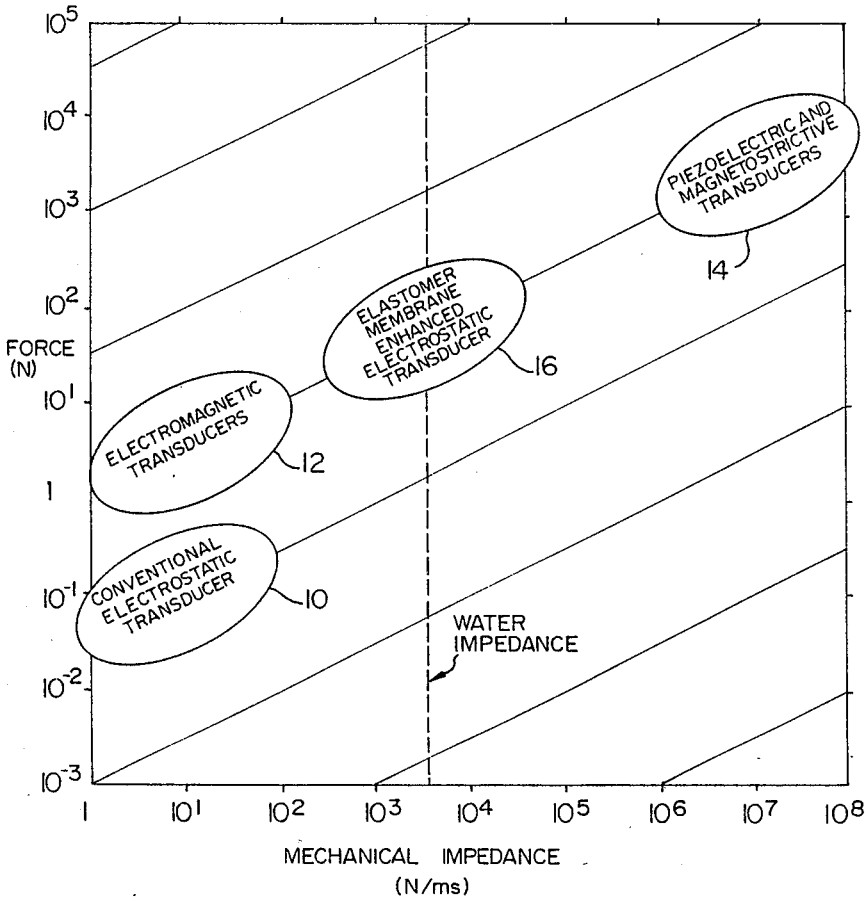
FIG. 1 is a graph in which force (expressed in Newtons) is plotted as the ordinate versus mechanical impedance (expressed in Newton seconds per meter) as the abscissa for various electrical-to-mechanical, transducers having a volume of about 100 milliliters.

FIG. 1 is a graph on which transducer force (expressed in Newtons) is plotted as the ordinate versus transducer mechanical impedance (expressed in Newton seconds per meter) as the abscissa for various electrical-to-mechanical transducers having a volume of about 100 milliliters. As indicated by region 10 on FIG. 1, conventional electrostatic transducers have mechanical impedances which vary from about 1 to about 100 Newton seconds per meter and are capable of producing forces of about 0.05 to about 0.5 Newtons. As shown by region 12 on FIG. 1, electromagnetic transducers exhibit the same range of mechanical impedance as conventional electrostatic transducers, but are capable of producing forces in a range which is roughly about one order of magnitude greater than the force range of conventional electrostatic transducers. Piezoelectric and magnetostrictive transducers, on the other hand, have extremely high mechanical impedance ranging from about $10^6$ to about $10^8$ Newton seconds per meter and are capable of producing forces in the range of about $10^3$ to about $10^4$ Newtons, as illustrated by region 14 in FIG. 1.

It can thus be seen that there is a wide range of mechanical impedance and forces which existing electrical-to-mechanical transducers are incapable of producing. This gap, illustrated by region 16 in FIG. 1, corresponds to an impedance range of about $10^2$ to about $10^6$ Newton seconds per meter and to a force range of about 10 to about $10^3$ Newtons. The present invention provides an elastomer membrane enhanced electrostatic transducer which fits neatly within this gap. That is, the transducer to be described exhibits mechanical impedance in the range of about $0.5\times10^3$ to about $0.5\times10^5$ Newton seconds per meter and is capable of generating forces in the range of about 10 to about $0.5\times10^3$ Newtons. There are a wide range of practical applications for which the transducer of the invention is ideally suited. These include machine tool actuators and vibrators, alignment preserving optical components in laser systems and underwater transducers.

Figure 2:
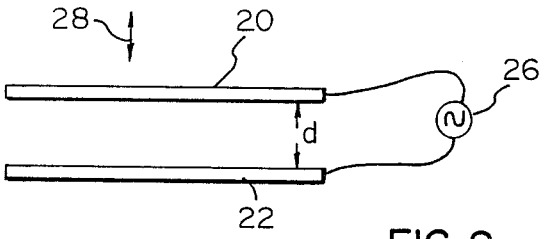
FIG. 2 is a greatly magnified cross-sectional side view of a portion of a typical electrostatic transducer.

FIG. 2 is a simplified cross-sectional side view of a conventional electrostatic transducer consisting of a pair of opposed metal plates 20, 22 which are separated a distance "d" by an air gap. If an A.C. voltage source 26 is connected across plates 20, 22 to establish an electrical potential difference across the plates an electrostatic force is generated which causes the plates to oscillate in the directions indicated by double headed arrow 28. The magnitude of such oscillation varies in proportion to the magnitude of the square of the applied voltage although, as indicated by region 10 in FIG. 1, only comparatively small forces can be produced by conventional electrostatic transducers. Moreover, there is a maximum breakdown voltage of about $10^6$ volts per meter beyond which any further increase in voltage across plates 20, 22 results in arcing between the plates, in which case the transducer fails due to a large increase in the flow of electrical current.

Figure 8:
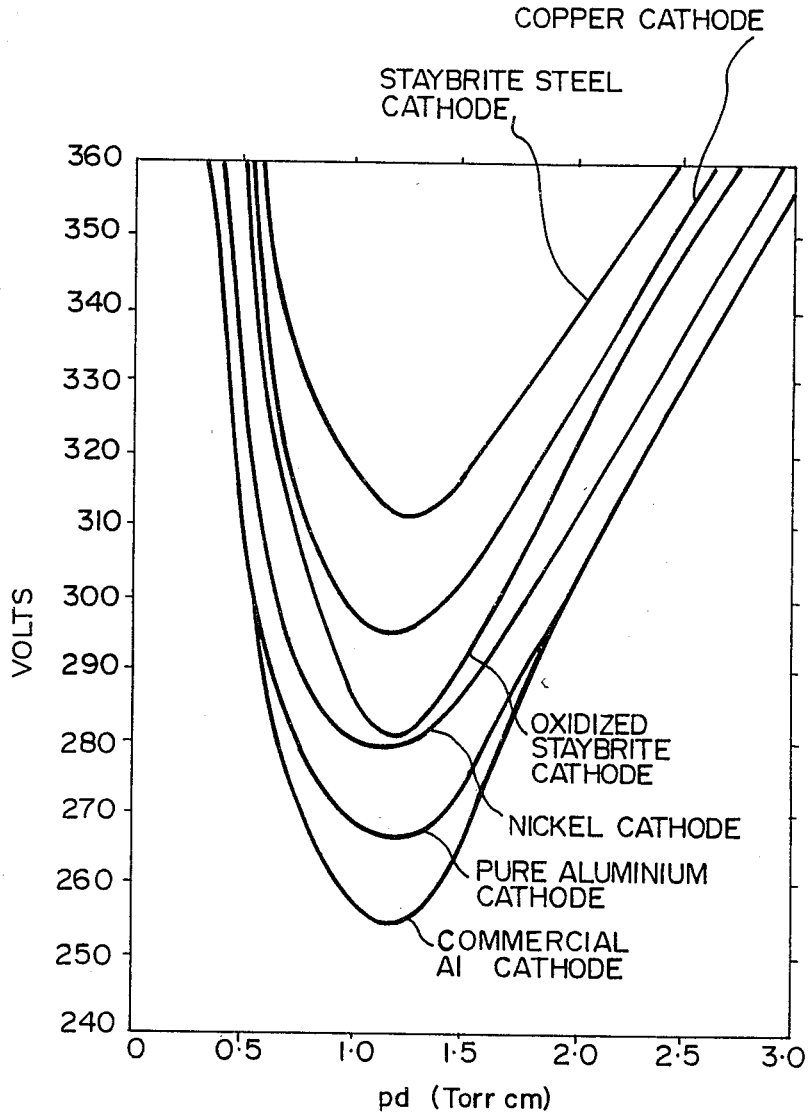
FIG. 8 is a graph in which the electrical breakdown voltage for forming a spark in a gas maintained at a pressure "P" (expressed in Torr) between two metal plates across which a voltage "V" (expressed in volts) is applied is plotted as the ordinate, versus the product Pd where "d" is the distance between the plates (expressed in centimeters). The graph includes plots for various "cathodes38 ; the "cathode" being the lower voltage plate.

FIG. 8 is a graph which illustrates the relationship between breakdown voltage "V", plate separation distance "d" and pressure "P" of the gas maintained between the opposed plates of an electrostatic transducer like that shown in FIG. 2. The graph shows that for a given cathode material (the "cathode" being the plate having the lower voltage) such as commercial aluminum, the breakdown voltage V decreases as the product Pd decreases, until a minimum voltage "$V_{min}$" is reached; and, that the breakdown voltage V then increases dramatically as the product Pd continues to decrease. It may thus be seen that if the gas pressure P is held constant, the breakdown voltage V decreases as the plate separation distance d decreases until the aforementioned minimum voltage $V_{min}$ (known as the "Paschen minimum") is reached, but the breakdown voltage V then increases dramatically as the plate separation distance d is further decreased. As FIG. 8 indicates, the Paschen minimum voltage for air, with a commercial aluminum cathode is about 254 volts, and occurs when the product Pd is about 1.2 Torr cm. If the gas pressure P is 1 atmosphere (i.e. 760 Torr) this corresponds to a plate separation distance d of about 1.2 Torr cm./760 Torr$=1.6\times10^{-3}$ cm. or about 16 microns.

It has been recognized that an electrostatic transducer capable of measuring small displacements can be made by making d as small as possible. [See: W. B. Gauster and M. A. Breazeale: "Detector for Measurement of Ultrasonic Strain Amplitudes in Solids", Rev. Sci. Instrum. 37, 1544–1548 (1966); and, J. H. Cantrell and J. S. Heyman: "Broadband Electrostatic Acoustic Transducer for Ultrasonic Measurements in Liquids", Rev. Sci. Instrum. 50, 31–33 (1979)]. Unfortunately however, it is very difficult to construct a practical electrostatic transducer having a plate separation gap "d" of only about 16 microns and the difficulty increases as "d" is further decreased (as it must be if an electrostatic transducer having higher breakdown voltages is to be produced). Expensive precision machining and cumbersome mounting techniques are required which preclude the use of such transducers in most practical situations.

The inventors have discovered that a practical electrostatic transducer which exploits the foregoing phenomenon may be easily constructed and operated at values of Pd which are significantly less than the value of Pd required to achieve the minimum breakdown voltage of the particular gas maintained between the transducer plates. The term "significantly" is used to imply that the breakdown voltage resulting from a particular value of Pd exceeds the minimum breakdown voltage by about 10% or more.

In accordance with a first embodiment of the invention, an elastomeric dielectric material is placed between plates 20, 22 of the FIG. 2 electrostatic transducer and is maintained in contact with both plates. It is of course well known to provide a dielectric material between a pair of opposed plates across which a voltage potential difference is maintained (as in a conventional capacitor). However, the inventors have discovered that if the dielectric material has very slight surface irregularities or pockets, and is elastomeric (for example, neoprene rubber), then the desired increase in gap breakdown voltage may be achieved, thereby facilitating production of transducers having mechanical impedance/force characteristics falling within region 16 depicted in FIG. 1, as a result of the deformability of the elastomeric dielectric material.

Figure 3:
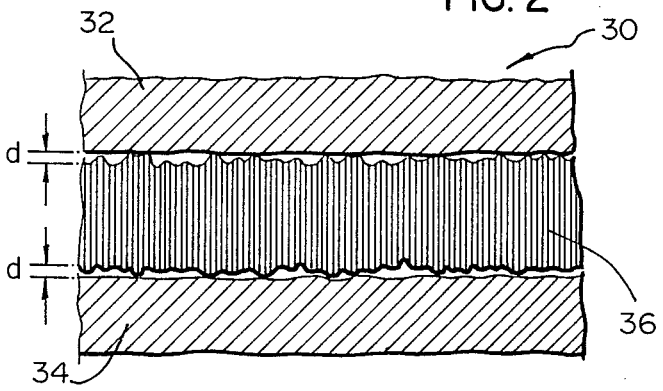
FIG. 3 is a greatly magnified cross-sectional side view of a portion of an elastomer membrane enhanced electrostatic transducer constructed in accordance with a first embodiment of the invention.
Figure 9:
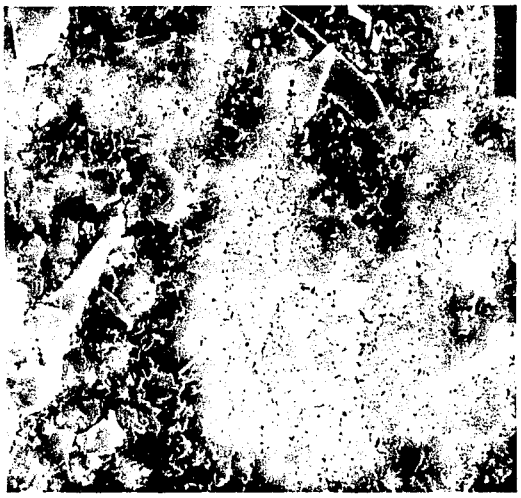
FIG. 9 is an electron micrograph of a neoprene rubber dielectric for use in constructing a transducer in accordance with the invention.

FIG. 3 is a greatly magnified cross-sectional side view of an electrostatic transducer 30 according to the first embodiment of the invention. Transducer 30 comprises a pair of thin aluminium plates 32, 34 across which an electrical potential difference is maintained by a voltage source (not shown). A compressible neoprene rubber dielectric 36 having a breakdown voltage of about $2\times10^7$ volts per meter is disposed between plates 32, 34 and in contact therewith. The surfaces of dielectric 36 adjacent plates 32, 34 are very slightly irregular such that, when viewed on the microscopic scale shown in the electron micrograph of FIG. 9, the surfaces exhibit a large plurality of pockets having an approximate average depth "d" of about 10 microns each. Accordingly, when dielectric 36 is disposed between plates 32, 34 there is a corresponding large plurality of discrete gaps on the order of about 10 microns between each of plates 32, 34 and the adjacent surfaces of dielectric 36. The aforementioned pockets would ordinarily be distributed throughout dielectric 36, and need not be confined to (or even present on) the surface of dielectric 36.

The slight surface irregularities of dielectric 36 provide, in effect, a gap of approximately 10 microns between each of plates 32, 34 and the adjacent faces of dielectric material 36. Alternatively, the pockets distributed throughout dielectric 36 constitute a large number of discrete, localized gaps of about 10 microns each. As discussed above with reference to FIG. 8, small gaps of this order of magnitude are capable of sustaining relatively high voltages before breakdown occurs. Moreover, because the dielectric material is elastomeric, plates 32,34 may oscillate significantly in response to the large electrostatic force corresponding to the large voltages sustainable by the slight surface irregularities or pockets of the dielectric. Dielectric material 36 thus facilitates the production of electrostatic forces on the order of the range of forces and mechanical impedances indicated by region 16 in FIG. 1.

The first embodiment of the invention described above and illustrated in FIG. 3 is subject to a number of shortcomings. For example, if dielectric material 36 is relatively thick in comparison to the average depth d of the dielectric surface irregularities or pockets, and if transducer 30 is operated with an A.C. voltage, then the effective efficiency of the device is decreased. This decrease arises because of the extra power consumed in the process of charging and discharging the relatively large volume of the dielectric material. Secondly, if the device is connected across a constant voltage source, small currents flowing through the dielectric surface irregularity or pocket gaps could, after a time, short out the electric field in the gaps, thereby reducing the electrostatic force to zero. A further shortcoming of such a device is that it could be difficult to manufacture inexpensively in large quantities. The foregoing shortcomings are overcome by the second and further alternative embodiments of the invention illustrated in FIGS. 4, 5, 6 and 7 which will now be described.

Figure 4:
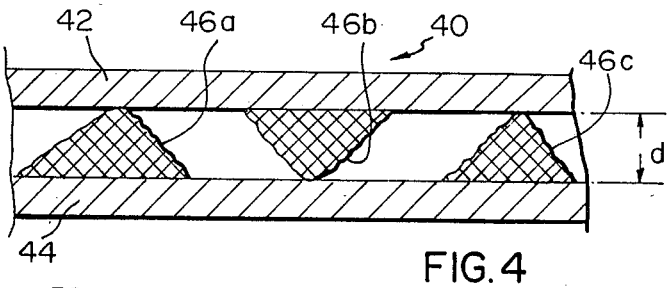
FIG. 4 is a greatly magnified cross-sectional side view of a portion of an alternative transducer constructed in accordance with a second embodiment of the invention.

FIG. 4 illustrates a transducer 40 having a pair of opposed metal plates 42, 44 across which an electrical potential difference is maintained by a voltage source (not shown). A plurality of strips, beads or nodules **46*a*, 46*b*, 46*c*, etc. of elastomeric dielectric material are disposed between plates 42 and 44 in contact therewith, thereby separating plates 42, 44 by a distance "d" such that, for a given gas maintained between plates 42, 44 at a pressure "P", the product Pd is significantly less than the value required to achieve the Paschen minimum breakdown voltage of the gas. There are known techniques for rapid application of thin strips or small beads of elastomeric material to surfaces, which may be adapted to construct the second embodiment of the invention illustrated in FIG. 4. Note that in the embodiment of FIG. 4 the thickness of the dielectric material is reduced to equal the desired minimum displacement "d" between plates 42, 44; thereby facilitating operation of the device at direct current voltages (i.e. because the gas is in contact with both plates 42 and 44**, small leakage currents cannot short out the field across the gas-filled gap).

Figure 5:
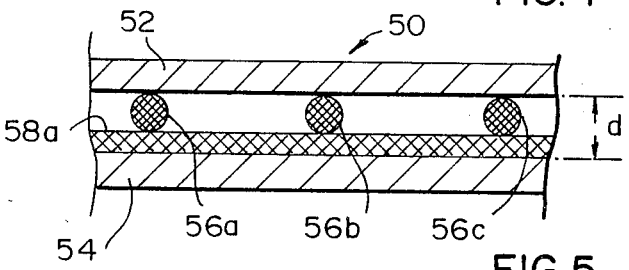
FIG. 5 is a greatly magnified cross-sectional side view of a portion of a further alternative transducer constructed in accordance with the invention.

FIG. 5 illustrates a further alternative embodiment of the invention comprising a transducer 50 having a pair of opposed metal plates 52, 54 across which an electrical potential difference is maintained by a voltage source (not shown). A first plurality of strips **56*a*, 56*b*, 56*c*, etc. of elastomeric dielectric material are disposed between plates 52, 54 in a first direction. That is, strips 56*a*, 56*b* and 56*c* have longitudinal axes perpendicular to the plane of the paper. A second plurality of strips of elastomeric dielectric material, only one of which; namely, strip 58*a* is visible in FIG. 5, are disposed between plates 52, 54 in a second direction which is different than the first direction. That is, strip 58*a* and the other strips comprising the second plurality of strips have longitudinal axes which are closer to the plane of the paper. The embodiment of FIG. 5 may be fabricated by utilizing known techniques to rapidly apply thin elastomeric beads to each of plates 52 and 54, following which the plates may be aligned with the axes of the beads so applied at an angle to each other. This minimizes the contact area between the dielectric material on the two plates 52, 54. The compliance of the elastomeric material is thus increased, resulting in reduced mechanical impedance. This feature is desirable when large displacements are needed in response to comparatively small voltages across plates 52, 54**.

Figure 6:
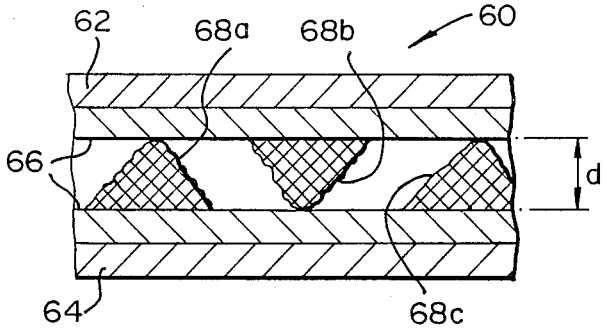
FIG. 6 is a greatly magnified cross-sectional side view of a portion of a still further alternative transducer constructed in accordance with the invention.

FIG. 6 illustrates a still further embodiment of the invention comprising a transducer 60 having a pair of opposed metal plates 62, 64 across which an electrical potential difference is maintained by a voltage source (not shown). An electrical insulating material 66 such as mylar or metal oxide is applied over each of the opposed surfaces of plates 62, 64. A plurality of strips, beads or nodules 68a, 68b, 68c, etc. of elastomeric dielectric material are then disposed between the opposed layers of insulating material. (FIG. 6 illustrates the use of beads or nodules of elastomeric material as shown in FIG. 4, but overlapping strips of elastomeric material could also be used as shown in FIG. 5.) Insulating material 66 serves to increase the breakdown voltage of the gasfilled gap maintained between insulating layers 66 by the elastomeric dielectric material. Since the gap is bounded by insulating material, electrical breakdown occurs in accordance with a process known as "electrodeless breakdown" or "external electrode breakdown". There is some evidence that the minimum breakdown voltage of a gas obtained via electrodeless breakdown exceeds that which is obtained when the gas is allowed to contact the electrodes [see: D. Friedmann, F. L. Curzon and J. Young: "A New Electrical Breakdown Phenomenon in Gas-Filled Insulating Bulbs", Appl. Phys. Lett. 38, 414–415 (1981)]. Increased breakdown voltage is desirable because transducer 60 could then produce larger electrostatic forces than those attainable in the absence of insulating material 66. Moreover, this reduces the risk of transducer failure by preventing arcing between plates 62, 64. Also, by ensuring that the average conductivity of insulating material 66 exceeds that of the gas, one can still maintain operation at constant voltages, without leakage through the air gap reducing the resulting electrostatic force.

The minimum breakdown voltage may also be increased by maintaining an electronegative gas such as carbon dioxide, sulphur hexafluoride or oxygen in the gap between plates 62, 64. Mixtures of electronegative and non-electronegative gases are expected to be particularly useful because the high breakdown voltage characteristics of electronegative gases could then be exploited in combination with the larger Pd values which characterize the Paschen minimum voltages of non-electronegative gases, which in turn implies that rougher surfaced dielectric materials (i.e. materials having surface pockets deeper than about 16 microns) could be used. The following table provides the Paschen minimum voltage (expressed in volts) and corresponding Pd values (expressed in Torr cm.) for three electronegative gases (carbon dioxide, sulphur hexafluoride and oxygen) and for one non-electronegative gas (air):

| | Paschen Min. Voltage | Pd |
|---|---|---|
| carbon dioxide | 488 | .45 |
| sulphur hexafluoride | 507 | .24 |
| oxygen | 446 | .8 |
| air | 260 | .6 |

Figure 7:
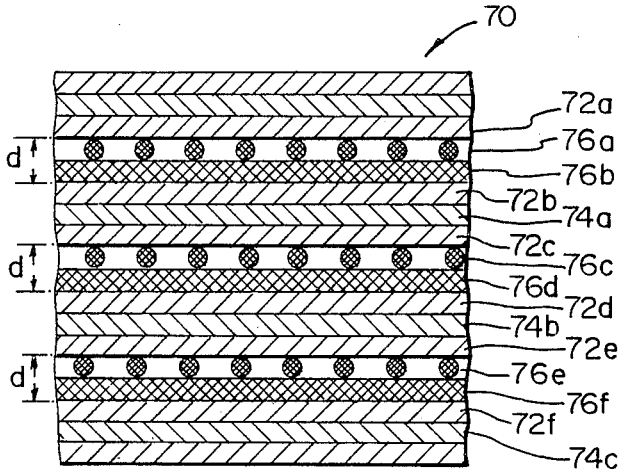
FIG. 7 is a greatly magnified cross-sectional side view of a portion of yet another alternative transducer constructed in accordance with the invention.

FIG. 7 illustrates yet another embodiment of the invention which, like the embodiment of FIG. 6, may be constructed by using alumininized mylar in continuous sheet form. The thin layer of aluminium deposited on the mylar serves as electrically conductive plate material for construction of transducers generally similar to those shown in FIGS. 4, 5 or 6. Thin beads, strips or nodules of elastomeric material may be applied to the aluminized mylar surface as explained above. The sheet of aluminized mylar may then be cut into a large number of individual plates which may then be stacked one on top of the other to construct a multilayer transducer 70 as shown in FIG. 7. As may be seen, transducer 70 includes a plurality of plates 72a, 72b, 72c, etc., each separated by a layer 74a, 74b, etc. of electrically insulating mylar. An electrical potential difference is maintained across the plates by a voltage source (not shown). The elastomeric material applied to the aluminized mylar serves as a compressible dielectric disposed between and in contact with each pair of opposed plates comprising the stack. Although FIG. 7 illustrates the use of overlapping strips 76a, 76b, 76c, etc. of elastomeric material as shown in FIG. 5, those skilled in the art will understand that strips, beads or nodules of elastomeric material could also be used as shown in FIG. 4. Furthermore, a layer of insulating material could also be disposed between each pair of opposed plates and the elastomeric dielectric material which separates the plates, as described above with reference to FIG. 6.

As in the embodiment of FIG. 5, the dielectric material 76a, 76b, 76c, etc. separates each of the pairs of opposed plates 72a, 72b, etc. comprising the stack by a distance "d" such that, for a given gas maintained between the plates at a pressure "P", the product Pd is significantly less than the value required to achieve the Paschen minimum breakdown voltage of the gas. The resultant transducer is capable of generating very large displacements, due to the cumulative effect of the displacements generated by each of the opposed pairs of plates comprising transducer 70.

There are a wide variety of practical applications for elastomer membrane enhanced electrostatic transducers constructed in accordance with the invention. As one example, the invention facilitates the production of an inexpensive, highly controllable device for generating small scale motions at forces falling within region 16 shown in FIG. 1. This may have application for example, in the control of machine tools in which fast, accurate, minute movements of a cutting tool are required. This is conventionally done with large, expensive hydraulic controls which are typically not very accurate when dimensions measured in thousandths of inches are to be accommodated.

The geometry of the transducer is readily adjusted to match its acoustic impedance to that of water. Therefore, transducers constructed in accordance with the invention may be directly coupled to water and are well suited for use in sonar underwater signalling applications, over a wide frequency band. Conventionally, in comparison, piezoelectric transducers are used in underwater sonar signalling applications but they are only capable of accommodating a very narrow band of frequencies centered on the resonant frequency of the particular piezoelectric crystal material utilized.

As will be apparent to those skilled in the art in the light of the foregoing disclosure, many alterations and modifications are possible in the practice in this invention without departing from the spirit or scope thereof. For example, in order to increase the available range of suitable dielectric materials, elastomeric materials may be combined with other essentially rigid (i.e. non-elastomeric) dielectric materials to produce composite dielectric structures which retain much of the deformability of elastomers and are thus still capable of exploiting the phenomenon outlined above to yield transducers exhibiting force and mechanical impedance characteristics falling within, or even beyond, region 16 shown in FIG. 1. The rigid dielectric portion could be applied to the conductive plates by painting, spraying, vacuum deposition, or other known techniques. Accordingly, the scope of the invention is to be construed in accordance with the substance defined by the following claims.

We claim:

1. A transducer, comprising:

(a) opposed first and second conductive plates for application of an electrical potential therebetween; and, (b) an elastomeric dielectric material disposed between said plates and in contact therewith;

said dielectric material having a plurality of pockets of approximate average depth "d" such that, for a gas existing within said pockets at a pressure "P", the product Pd is significantly less than the value required to achieve the minimum breakdown voltage of said gas.

2. A transducer, comprising:

(a) opposed first and second conductive plates for application of an electrical potential therebetween; and, (b) an elastomeric dielectric material disposed between said plates and in contact therewith, for separating said plates by a distance "d" and for allowing a gas to exist between said plates at a pressure "P", wherein the product Pd is significantly less than the value required to achieve the minimum breakdown voltage of said gas.

3. A transducer, comprising:

(a) a plurality of conductive plates arranged in a stack for application of an electrical potential between each pair of opposed plates comprising said stack; and, (b) an elastomeric dielectric material disposed between and in contact with each pair of opposed plates comprising said stack;

said dielectric material separating each of said pairs of opposed plates by a distance "d" and for allowing a gas to exist between said plates at a pressure "P", wherein the product Pd is significantly less than the value required to achieve the minimum breakdown voltage of said gas.

4. A transducer as defined in claim 1, 2 or 3, further comprising an electrical insulating material disposed between each of said plates and said elastomeric dielectric material.

5. A transducer as defined in claim 1, 2 or 3 wherein said gas is air, "P" is normal atmospheric pressure, and "d" is less than about 16 microns.

6. A transducer is defined in claim 1, 2 or 3 wherein said dielectric material is neoprene rubber.

7. A transducer as defined in claim 1, 2 or 3 wherein said gas is an electronegative gas, "P" is normal atmospheric pressure and "d" is less than about 10 microns.

8. A transducer as defined in claim 1, 2 or 3 wherein said gas is a mixture of electronegative and non-electronegative gases.

9. A transducer as defined in claim 1, 2 or 3 wherein said plates are formed of aluminized mylar.

10. A transducer as defined in claim 1, 2 or 3, wherein said dielectric material is disposed at a plurality of sites between said plates, leaving said gas between and in contact with said plates at regions other than said sites.

11. A transducer as defined in claim 2 or 3, wherein:

(a) a first plurality of strips of elastomeric dielectric material are disposed between said plates in a first direction; and, (b) a second plurality of strips of elastomeric dielectric material are disposed between said plates in a second direction different than said first direction.

12. A transducer as defined in claim 1, 2 or 3, wherein said dielectric material is a composite structure of elastomeric and non-elastomeric material.

* * * * *